US009957776B2

(12) United States Patent
Shaw

(10) Patent No.: US 9,957,776 B2
(45) Date of Patent: May 1, 2018

(54) CONTROL SYSTEM INCLUDING SINGLE LINE SWITCHES AND METHOD

(71) Applicant: Joel D. Shaw, Houston, TX (US)

(72) Inventor: Joel D. Shaw, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 647 days.

(21) Appl. No.: 14/524,127

(22) Filed: Oct. 27, 2014

(65) Prior Publication Data

US 2016/0118209 A1 Apr. 28, 2016

(51) Int. Cl.
*E21B 34/10* (2006.01)

(52) U.S. Cl.
CPC ..... *E21B 34/10* (2013.01)

(58) Field of Classification Search
CPC ..... E21B 34/10; E21B 2034/007
See application file for complete search history.

(56) References Cited

U.S. PATENT DOCUMENTS

| | | | |
|---|---|---|---|
| 3,993,100 | A | 11/1976 | Pollard et al. |
| 4,132,383 | A | 1/1979 | Clinton |
| 4,530,377 | A | 7/1985 | Peters |
| 5,832,996 | A | 11/1998 | Carmody et al. |
| 7,367,393 | B2 | 5/2008 | Vachon |
| 7,654,331 | B2 | 2/2010 | Wolters |
| 7,730,953 | B2 | 6/2010 | Casciaro |
| 7,748,461 | B2 | 7/2010 | Loretz et al. |
| 8,757,193 | B2 | 6/2014 | Launderale |
| 2003/0132006 | A1 | 7/2003 | Bussear et al. |
| 2004/0050555 | A1 | 3/2004 | Rayssiguier et al. |
| 2006/0254763 | A1 | 11/2006 | Tips et al. |
| 2009/0218102 | A1 | 9/2009 | Casciaro |

FOREIGN PATENT DOCUMENTS

WO 2006001974 A2 1/2006

OTHER PUBLICATIONS

Mazerov, Katie; "Industry maps smarter way to build wellbores"; Jul./Aug. 2012 issue of Drilling Contractor.org; 5 pages.
Notification of Transmittal of the International Search Report and the Written Opinion of the International Searching Authority, or the Declaration; PCT/US2015/049955; dated Dec. 10, 2015: 8 pages.
Westgard, et al.; "Multilateral, intelligent technologies prove winner for Glitne"; Published in Offshore Magazine, vol. 65, Issue 1, 2005; 5 pages.

*Primary Examiner* — D. Andrews
(74) *Attorney, Agent, or Firm* — Cantor Colburn LLP

(57) ABSTRACT

A control system and method of controlling a control system includes a set of pressure-controlled devices having at least a first device and a second device movable between at least first and second positions, and a set of single line switches including at least a first switch and a second switch, each switch configured to move the pressure-controlled devices, respectively, between the first and second positions. The first device alternates between the first position and the second position with every position changing pressure pulse to the first switch, and the second device alternates between the first position and the second position with every two position changing pressure pulses to the first switch.

23 Claims, 7 Drawing Sheets

| 2X1 SYSTEM | | |
|---|---|---|
| CYCLE | UPPER | LOWER |
| 0 | O | O |
| 1 | C | O |
| 2 | O | C |
| 3 | C | C |

| 4X1 SYSTEM | | | | |
|---|---|---|---|---|
| STEP | A | B | C | D |
| 0 | O | O | O | O |
| 1 | C | O | O | O |
| 2 | O | C | O | O |
| 3 | C | C | O | O |
| 4 | O | O | C | O |
| 5 | C | O | C | O |
| 6 | O | C | C | O |
| 7 | C | C | C | O |
| 8 | O | O | O | C |
| 9 | C | O | O | C |
| 10 | O | C | O | C |
| 11 | C | C | O | C |
| 12 | O | O | C | C |
| 13 | C | O | C | C |
| 14 | O | C | C | C |
| 15 | C | C | C | C |

| 4X2 SYSTEM | | | | | |
|---|---|---|---|---|---|
| STEP LINE 1 | STEP LINE 2 | A | B | C | D |
| 0 | X | X | X | O | O |
| 1 | X | X | X | C | O |
| 2 | X | X | X | O | C |
| 3 | X | X | X | C | C |
| X | 0 | O | O | X | X |
| X | 1 | C | O | X | X |
| X | 2 | O | C | X | X |
| X | 3 | C | C | X | X |

CONTROL SYSTEM INCLUDING SINGLE LINE SWITCHES AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. The degree of fluidity and the makeup of deposits varies, and therefore it is desirable to have the ability to control flow from different deposits into the borehole. Flow control devices are typically actuable from a remote location, such as a surface location, by a well operator. One common configuration for remote actuation is a pair of hydraulic control lines. One of the lines is employed to force the flow control device to an open position while the other is employed to force the device to a closed position.

As downhole systems have become increasingly complex and expansive, a greater number of flow control valves and other downhole equipment has been placed downhole to enhance return on investment. With the additional devices downhole comes a requirement to provide a control regime for such devices. While hydraulic control lines have worked well for the intended purpose, the multiplicity of valves and controllable devices causes the number of control lines required with today's technology to exceed the space available to run them. For example, if a completion system is run into 15000 feet of borehole and includes 40 flow control valves, it is easily imagined that the needed 40 plus control lines to operate the flow control valves will have difficulty fitting in a typical 9⅝ inch annulus around a completion string.

The art would be receptive to improved devices and methods for reducing the number of control lines in a system architecture.

BRIEF DESCRIPTION

A control system includes a set of pressure-controlled devices having at least a first device and a second device movable between at least first and second positions, and a set of single line switches including at least a first switch and a second switch, each switch configured to move the pressure-controlled devices, respectively, between the first and second positions. The first device alternates between the first position and the second position with every position changing pressure pulse to the first switch, and the second device alternates between the first position and the second position with every two position changing pressure pulses to the first switch.

A method of controlling a control system for pressure-controlled devices including at least a first device and a second device, each device movable between at least first and second positions, includes connecting a first single line switch to the first device and a second single line switch to the second device. The method further includes delivering position changing pressure pulses to the control system, including delivering position changing pressure pulses to the first single line switch to alternatingly move the first device between the first and second positions with every position changing pressure pulse, and delivering position changing pressure pulses to the second single line switch to alternatingly move the second device between the first and second positions with no more than every other position changing pressure pulse delivered to the first single line switch.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figures 1, 2:
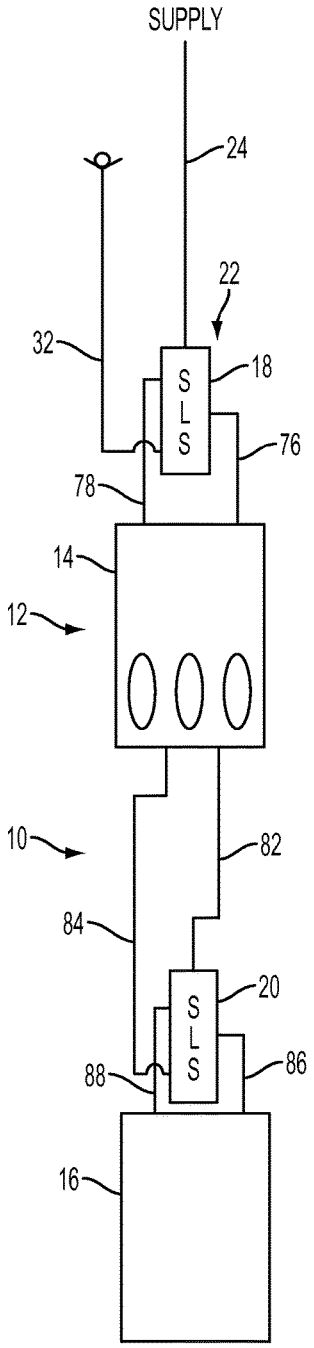
FIG. 1 depicts a schematic of an exemplary embodiment of a 2×1 control system for pressure-controlled valves in a downhole completion system.
FIG. 2 depicts a table of valve positions using the control system of FIG. 1.

With reference to FIG. 1, an exemplary embodiment of a control system 10 includes a set of pressure controlled devices 12, such as first and second sliding sleeve valves 14, 16 and other flow control valves, each respectively controlled by first and second single line switches 18, 20 of a switching system 22 of the control system 10. While only two pressure controlled devices 12 are depicted in FIG. 1, it should be understood that any number of additional pressure controlled devices 12 may be incorporated. The control system 10 is employable as part of an overall completion system to control the flow of fluids from particular areas in a formation into a production string and to the surface in an uphole direction. Although, alternatively, the first and second valves 14, 16 may be employed in an injection scenario where injected fluids are passed in a downhole direction and to the formation when a particular valve is opened. It should be understood that the control system 10 is illustrated in FIG. 1 in a manner to clearly depict the fluid connections between the valves 14, 16 and the switches 18, 20. In an exemplary embodiment of a completion system, a tubular string would be connected to the valves 14, 16 so that the valves 14, 16 and the tubular string would provide a flow path to surface. Fluids from the formation would be allowed to enter the flow path via a radial aperture in an opened valve 14, 16, and the switches 18, 20 could be positioned exteriorly of the flow path of the tubular string, such as at a periphery of the valves 14, 16 or string. An exemplary embodiment of the valves 14, 16 will be further described below with respect to FIGS. 6 and 7.

The switches 18, 20 shown in FIG. 1 are supplied with actuation pressure pulses, or position changing pressure pulses, by a single supply line 24, such as a supply line that extends from a surface of the borehole in which the completion system is provided, thus the term "single line" switch. Since the switches 18, 20, at least within a set of switches, do not need a separate supply line, the number of control lines required for the control system 10 is reduced. In an exemplary embodiment of the control system 10, a hydraulic controller is located at the surface. The controller is a fluid pump that may be controlled manually or automatically, such as by means of a computer. The supply line 24 extends from the controller into the borehole. The supply line 24 is directly connected to the first switch 18 within a set of switches, and is only indirectly connected to the second switch 20, with the first switch 18 interposed, at least within a fluidic flowpath of the position changing pressure pulses, between the second switch 20 and the supply line 24, as will be further described below.

Figure 6:
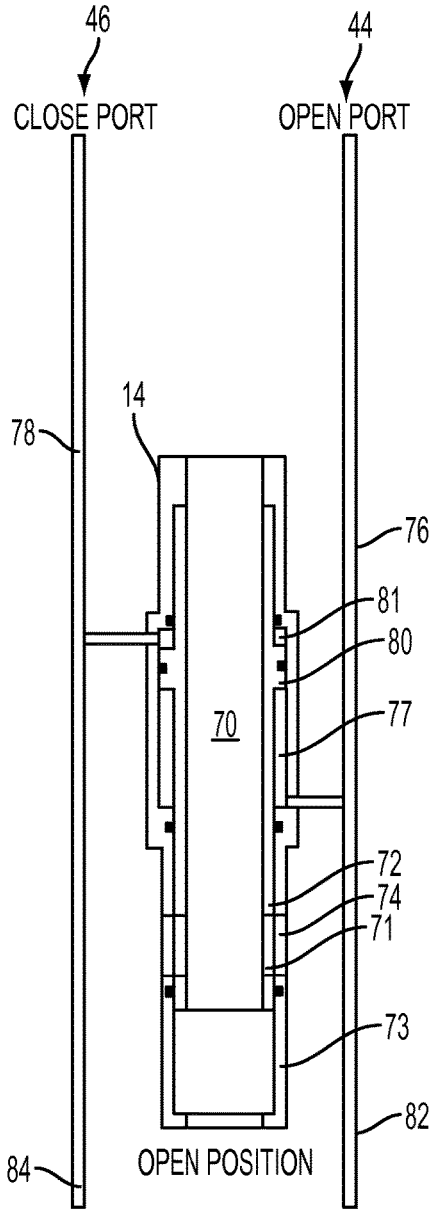
FIG. 6 depicts a schematic of an exemplary embodiment of a valve employable in the control system of FIG. 1 and in an open position.
Figure 7:
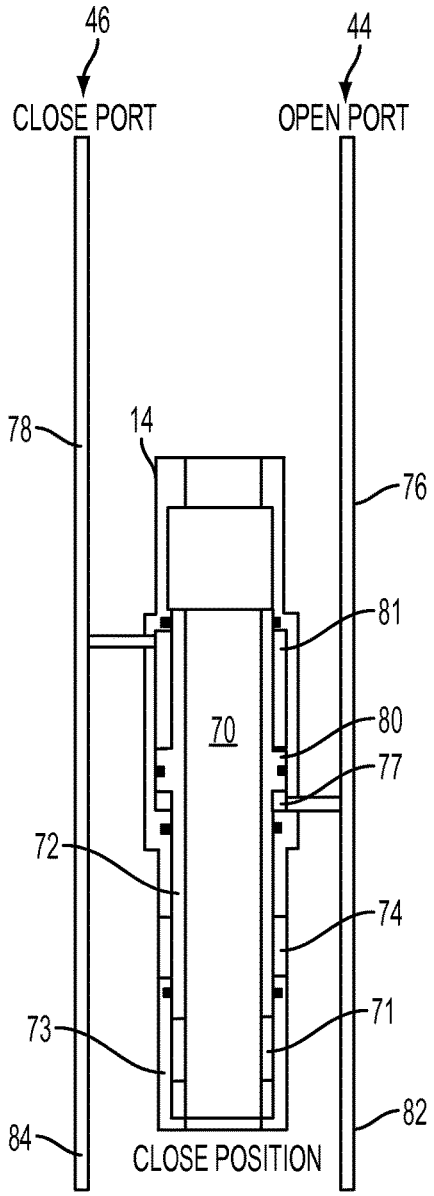
FIG. 7 depicts a schematic of an exemplary embodiment of a valve employable in the control system of FIG. 1 and in a closed position.

As further shown in the table in FIG. 2, each pressure cycle or position changing pressure pulse, of the supply line 24 will change the position of the first valve 14 (upper valve). If both valves 14, 16 are in the open position O in cycle 0, then the following position changing pressure pulse in cycle 1 will move the first valve 14 from the open position O to the closed position C. That is, if the valve 14 is a flow control valve, the valve 14 will move from an open position O (such as shown in FIG. 6), where radial flow ports are exposed and fluid can flow from the annulus (between a borehole wall and the outside of the production string) into the flow path of the production string, to a closed position C (such as shown in FIG. 7) where the flow ports are blocked and fluid cannot enter into the valve 14 and production string. A subsequent position changing pressure pulse in cycle 2 of the supply line 24 will move the first valve 14 from the closed position C back to the open position O, and then the next position changing pressure pulse in cycle 3 of the supply line 24 will move the first valve 14 from the open position O to the closed position C. The second valve 16 (lower valve), however, will only change position every other time the first valve 14 changes position. The second valve 16 will thus be in the open position O for cycle 0 and cycle 1, and will not change to the closed position C until the second cycle 2, and will remain in the closed position C for cycle 3. The first valve 14 thus changes position twice as many times as the second valve 16, and the second valve 16 changes position only half as many times as the first valve 14. As can be seen from reviewing the table in FIG. 2, by cycling the pressure on the supply line 24 four times, the first and second valves 14, 16 shift through every combination of positions, including both valves 14, 16 open, first valve 14 closed and second valve 16 open, first valve 14 open and second valve 16 closed, and both valves 14, 16 closed. Thus, by merely pressuring the single supply line 24 into the first switch 18, the control system 10 can be used to open and close each of the first and second valves 14, 16 in any combination of open and closed positions.

Figure 3:
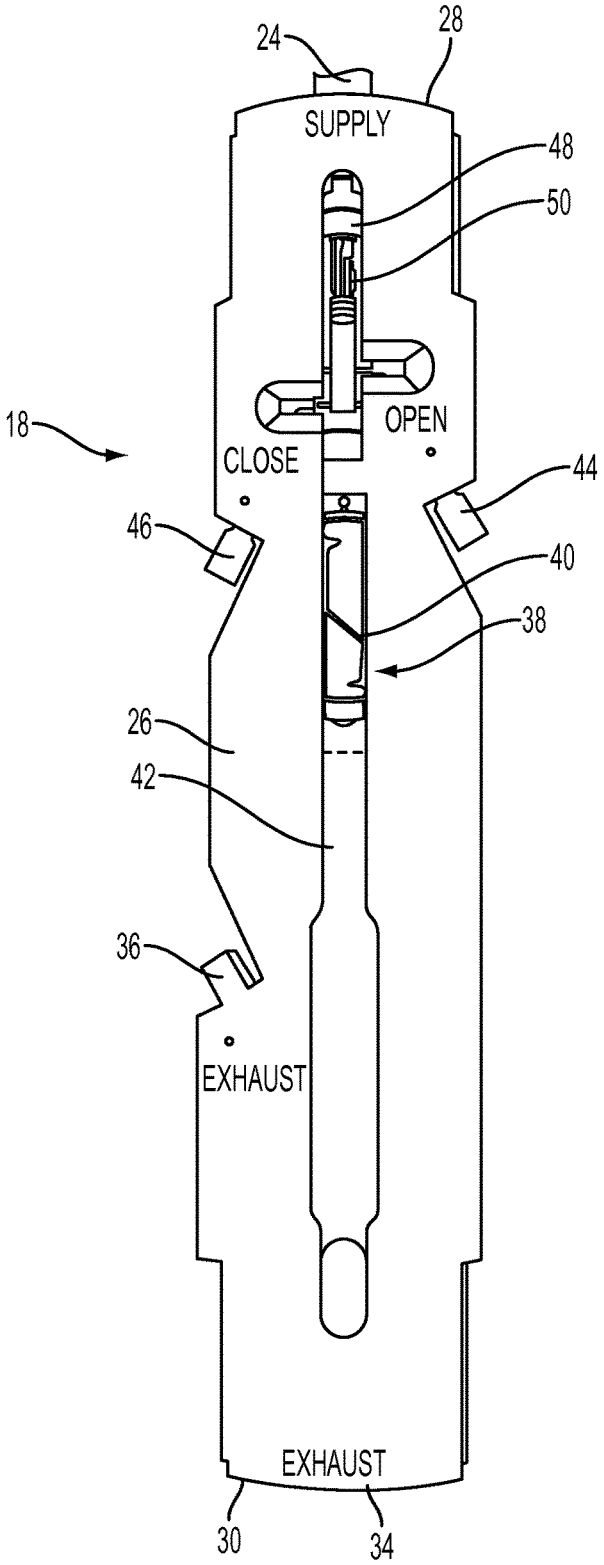
FIG. 3 depicts a partial cross-sectional view of an exemplary embodiment of a single line switch employable in the control system of FIG. 1 and in a home position.
Figure 4:
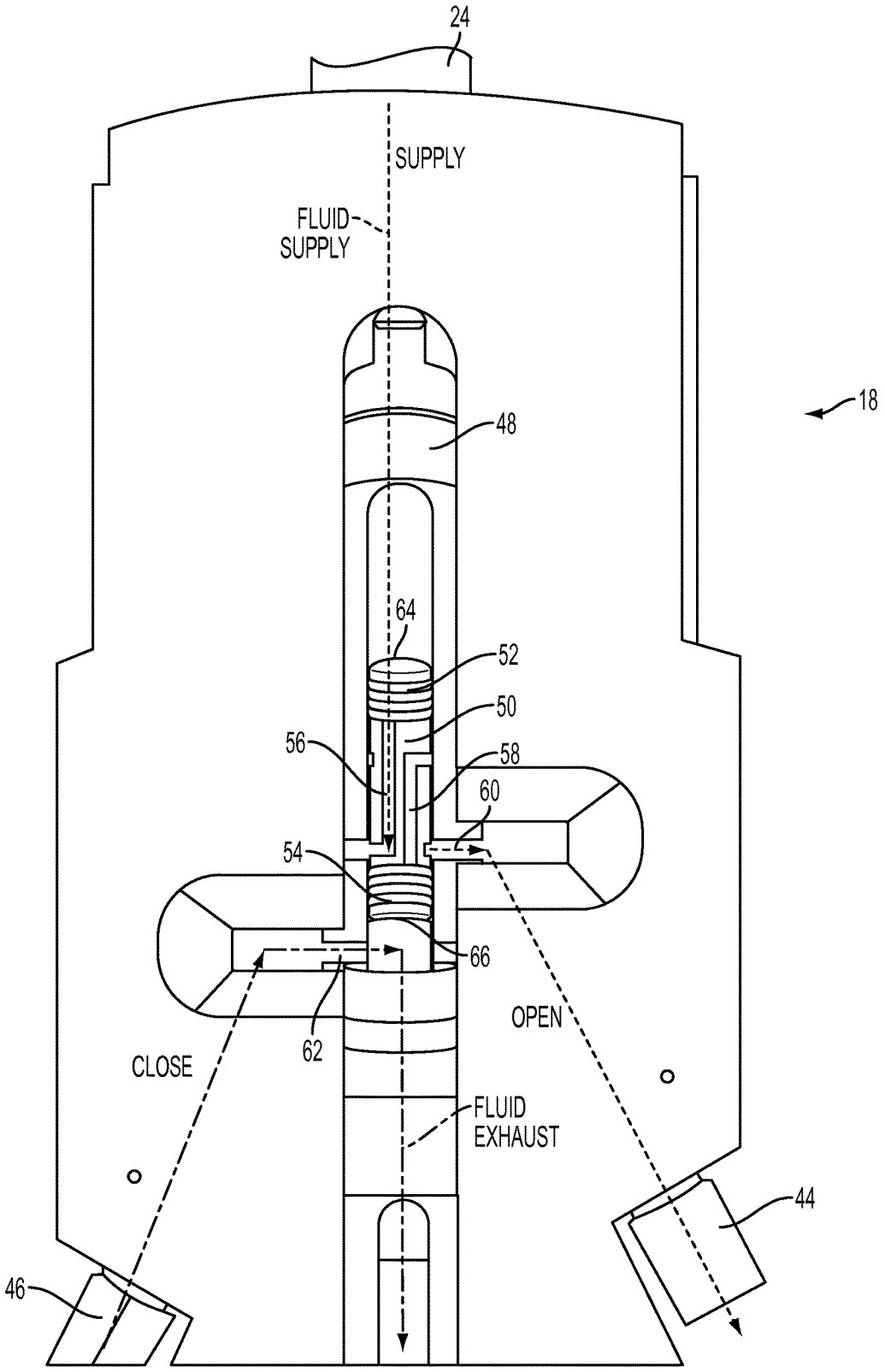
FIG. 4 depicts a partial cross-sectional view of the exemplary single line switch of FIG. 3 in an open position.
Figure 5:
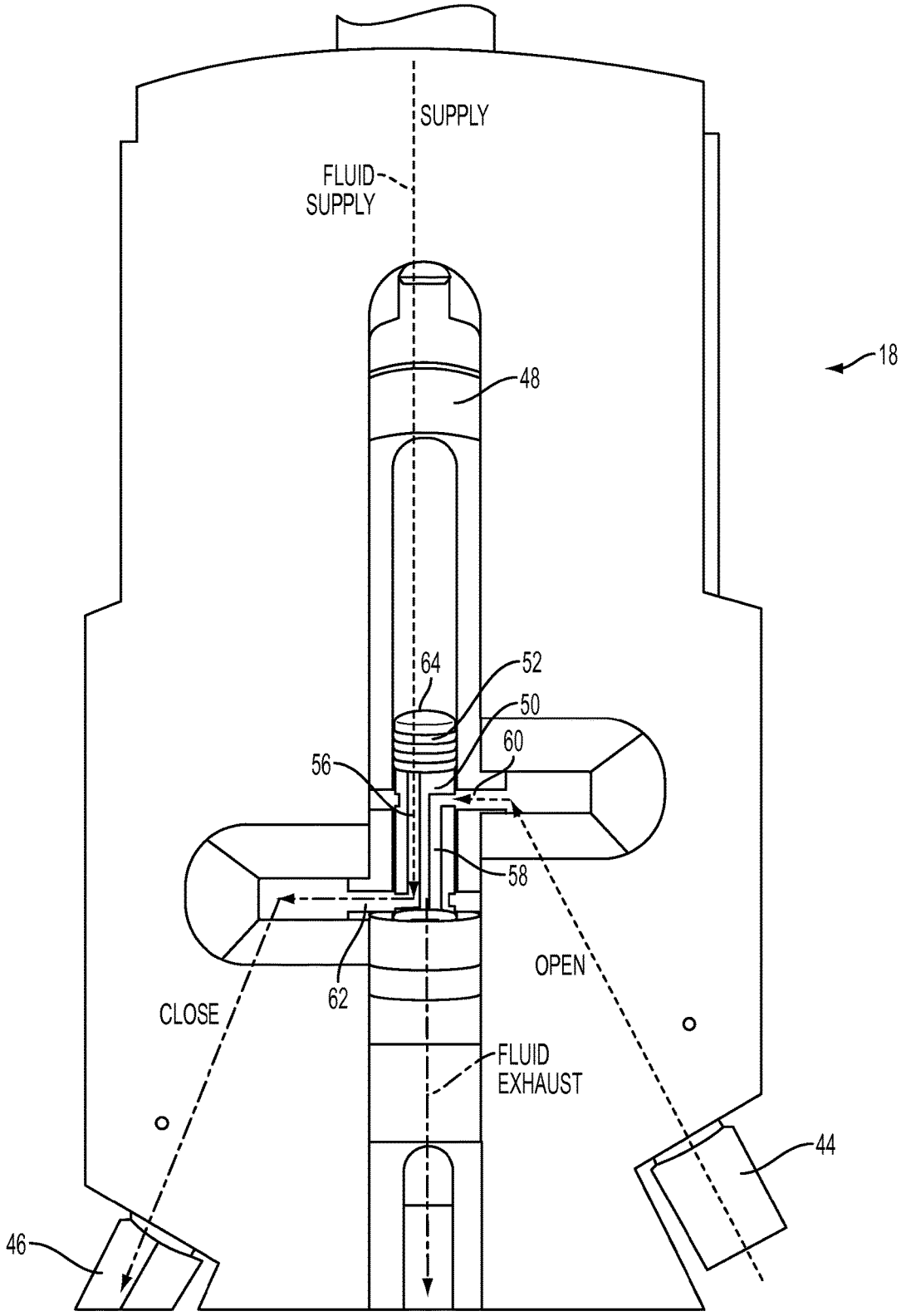
FIG. 5 depicts a partial cross-sectional view of the exemplary single line switch of FIG. 3 in a closed position.

To further understand how the switches 18, 20 and valves 14, 16 operate, reference may be made to FIGS. 3-7. FIGS. 3-5 depict home, open, and close positions, respectively, of an exemplary embodiment of a single line switch, such as the first switch 18. It should be understood that while a specific embodiment of a single line switch is shown in FIGS. 3-5, other constructions of single line switches may alternatively be provided and still be able to open and close the pressure controlled devices 12 as described herein. Further, while only an exemplary embodiment for switch 18 is shown, it should be understood that a similar switch construction may be adopted for the other switches described herein, including switch 20 shown in FIG. 1, switches 98, 100 shown in FIG. 8, and switches 218, 220, 318, and 320 shown in FIG. 10. The exemplary embodiment of a switch 18 depicted in FIGS. 3-5 includes a body 26 having an uphole end 28 attached to the supply line 24, and a downhole end 30 attached to an exhaust or vent line 32. Two exhaust ports 34, 36 may be provided, which may be connected to each other and may vent downhole. A spring biased J-track device 38 including a J-track 40 controls stroke stop position. The J-track device 38 is longitudinally and rotationally supported within a J-track device chamber 42 in the body 26. The J-track 40 in the J-track device 38 is a lug path or slot inscribed around an outer periphery of the J-track device 38. The body 26 supports or otherwise includes at least one lug member for following within the J-track 40 when the J-track device 38 is shifted longitudinally within the J-track device chamber 42. Because of the inscribed path of the J-track 40, the J-track device 38 will be forced to move rotationally within the J-track chamber 42 of the body 26 when the J-track device 38 is shifted longitudinally. The J-track device 38 is biased in the home position shown in FIG. 3 via a spring (or other biasing mechanism) downhole of the J-track device 38 within chamber 42. The body 26 further includes an open port 44 (or first position port) and a close port 46 (or second position port) that fluidically communicate to exhaust ports 34 and/or 36 in the home position through the J-track device 38.

A spool support 48 is disposed within the body 26, and a longitudinally movable spool 50 is supported within the spool support 48. The longitudinally movable spool 50, more clearly shown in FIG. 4, includes a first end having a first seal 52, a second end having a second seal 54, a first pathway 56, and a second pathway 58. The spool support 48 includes a first radial port 60, and a second radial port 62 aligned with the open port 44 and the close port 46, respectively. The spool 50 further includes a supply communication port 64 in the first end that connects the first pathway 56 to either the first or second radial port 60, 62 depending on the longitudinal position of the spool 50, and a vent communication port 66 in the second end that fluidically connects to the second pathway 58. In the home position, the spool 50 is closer to an uphole end of the spool support 48 because the J-track device 38 is in the biased position. When provided with supply pressure via supply line 24, the spool 50 moves in downhole direction with the J-track device 38, compressing the spring within chamber 42 and moving the spool 50 closer to a downhole end of the spool support 48.

With reference to FIG. 4, when the spool 50 is in the position shown, due to supply line pressurization and J-track positioning of the spool 50, fluid from the supply line 24 is directed through the first pathway 56 and out the first radial port 60 to the open port 44. The first radial port 60 may be fluidically connected to a ring shaped space such that the spool 50 need not be rotationally aligned with first radial port 60 in order to fluidically communicate with first radial port 60, as long as the opening in the first pathway 56 is longitudinally aligned with the radial port 60. Also, the second radial port 62 is not fluidically connected to the first pathway 56 in the spool 50, due to the spool 50 being longitudinally spaced from the second radial port 62, so fluid from the close port 46 is directed to the second radial port 62 to exhaust. When the position changing pressure pulse is over (such as when the pressure from the supply line 24 is less than a pressure required to compress the spring of the J-track device 38), the spring will de-energize and return the J-track device 38 and the connected spool 50 to the home position shown in FIG. 3. In doing so, the J-track device 38 and spool 50 will rotate slightly with the longitudinal movement due to the path of the J-track 40 riding over the stationary lug in the body 26. When the spool 50 is moved to the position shown in FIG. 5, due to supply line pressurization and J-track positioning of the spool 50, fluid is directed through the first pathway 56 to the second radial port 62 to the close port 46, and fluid is directed from the open port 44 to the first radial port 60, and then through the second pathway 58 to exhaust. Upon completion of the pressure pulse, the switch 18 will return to the home position shown in FIG. 3.

The valves 14, 16 are movable at least from an open position to a closed position, and from a closed position to an open position. Although, in alternative embodiments, additional or alternative positions may be incorporated such as a "choke" position between an open and closed position. Although the pressure controlled devices 12 movable between positions may take on various configurations, for demonstrative purposes only, an exemplary embodiment of first valve 14 is shown in FIGS. 6-7. It should be understood that the other valves described herein may adopt a similar construction as shown, including valve 16 shown in FIG. 1, valves 94, 96 shown in FIG. 8, and valves 214, 216, 314, and 316 shown in FIG. 10. The exemplary embodiment of first valve 14 depicted in FIGS. 6-7 includes an interior chamber 70 and a sliding sleeve member 72 longitudinally movable within a ported valve housing 73. The sleeve member 72 is shown in a first position in FIG. 6, where openings 71 in the sleeve member 72 are aligned with fluid openings 74 in the valve housing 73 so as to not block fluid openings 74. In this position, the valve 14 is "open" and allows production fluids within the annulus to enter the chamber 70 for transport to the surface via the string to which the valve 14 is connected. The sleeve member 72 can be moved to a second position, shown in FIG. 7. In the second position, the sleeve member 72 blocks the fluid openings 74, and the valve 14 is considered to be "closed" such that production fluids in the annulus cannot enter the chamber 70 or production string.

With reference to FIGS. 4 and 6, when the first pathway 56 fluidically aligns with the first radial port 60, fluid from the supply line 24 is communicated to the open port 44 (or first position port) and an open line (or first position line) 76, which is fluidically connected to a first piston chamber 77 on a first side of a piston portion 80 of the sleeve member 72. A close line (or second position line) 78 fluidically connected to a second piston chamber 81 on a second side of the piston portion 80 is connected to the close port 46 (or second position port) to return fluid to the close port 46 and fluid will be exhausted. As can be understood via FIGS. 6 and 7, fluidic pressure to the first piston chamber 77 will force the piston portion 80 towards the second piston chamber 81, and the connected sleeve member 72 will likewise move longitudinally, thus moving the valve 14 to the open position or condition. The sliding sleeve 72 remains in this position even after completion of the pressure pulse, when the switch 18 returns to the home position. As further shown in FIGS. 5 and 7, when the first pathway 56 is fluidically aligned with the close port 46, fluid from the supply line 24 is communicated to the close port 46 and the close line 78 connected to the second piston chamber 81. In the example embodiment shown, this can push the piston portion 80 as shown in FIG. 7 to force the sliding sleeve 72 to the closed position, covering the fluid openings 74 in the valve 14. Thus, only a single supply line 24 is required to move the valve 14 to either the open or the closed position.

With further reference to FIG. 1, it can be seen that the supply line 82 for the second valve 16, hereinafter referred to as the connecting supply line 82, is connected via the first valve 14 to the first open line 76, and that the vent line 84 for the second valve 16, hereinafter referred to as the connecting vent line 84, is connected via the first valve 14 to the first close line 78. Thus, for the purposes of this description, the supply line 24 to the first switch 18 will be referred to as the primary supply line 24, and the vent line 32 as the primary vent line 32. Assuming first valve 14 and second valve 16 are each in a closed position, pressuring up on primary supply line 24 in cycle 0 will switch (shift) the first switch 18 to fluidically connect the primary supply line 24 to the first open line 76 (via the first pathway 56 in the spool 50), thus pressuring up on first open line 76 to open the first valve 14. At the same time, connecting supply line 82 is pressured up which shifts the second switch 20 and pressures up the second open line 86 (first position line of second switch 20) to open the second valve 16. Meanwhile, pressure may be exhausted from the first and second valves 14, 16 through the first and second closed lines 78, 88, which are connected to the primary and connecting vent lines 32, 84 through the first and second switches 18, 20, respectively.

Then, pressuring up again on primary supply line 24 in cycle 1 will shift the first switch 18 to fluidically connect the primary supply line 24 to the first close line 78, thus closing the first valve 14, and at the same time pressuring up on the connecting vent line 84. Pressuring up on the connecting vent line 84, however, does not shift the second switch 20, since only pressure to the connecting supply line 82 can move the J-track device 40 and spool 50 within the second switch 20 to a new position. However, the second switch 20 will be returned to the home position after cycle 0, and therefore will remain in the home position in cycle 1, and thus the open and close ports communicate to the exhaust ports 34, 36. Thus, when the connecting vent line 84 is pressured up, pressure will fluidically connect to both the open and close ports, balancing pressure to both sides of the second valve 16 (such as both the first and second piston chambers 77, 81). Since the valve 16 is pressurized equally (or at substantially the same), there will be no movement of the second valve 16, and the second valve 16 remains in the open position.

Then, pressuring up on the primary supply line 24 again in cycle 2 will shift the first switch 18 such that the primary supply line 24 is fluidically connected to the first open line 76 as in cycle 0. By pressuring up on the first open line 76, the first valve 14 will be opened and the connecting supply line 82 will also be pressured up which shifts the second switch 20. This time, the spool in the second switch 20 will be cycled to fluidically connect the connecting supply line 82 to the second close line 88, and by pressuring up on the second close line 88, the second valve 16 is closed. Pressure from the second valve 16 may be exhausted through the second open line 86, the connecting vent line, 84 the first close line 78, and the primary vent line 32.

Finally, pressuring up on the primary supply line 24 again in cycle 3 will shift the first switch 18 such that the primary supply line 24 is fluidically connected to the first close line 76. By pressuring up on the first close line 76, the first valve 14 will be closed and the connecting vent line 84 will be pressured up. Because the second switch 20 is not shifted, the second switch 20 remains in the home position such that the open and close ports 44, 46 of the second switch 20 may communicate to the exhaust ports 34, 36 in the second switch 20, as described above in cycle 1 and the second valve 16 remains in the closed position. Thus, the second valve 16 only changes position with every two position changing pressure pulses to the first switch 18.

Figures 8, 9:
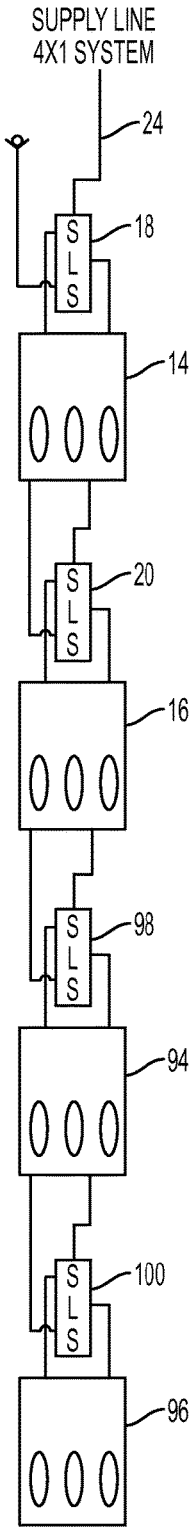
FIG. 8 depicts a schematic of an exemplary embodiment of a 4×1 control system for pressure-controlled valves in a downhole completion system.
FIG. 9 depicts a table of valve positions using the control system of FIG. 8.

More valves can be added to the control system 10, however it would take more pressure cycles to go through all of the possible combinations of positions. For example, as shown in FIGS. 8 and 9, third and fourth valves 94, 96 are added, with a third and fourth switch 98, 100 to make a 4×1 system (four valves, one supply line 24). This system requires 16 cycles to go through every combination of positions between the four valves 14, 16, 94, 96. As with the 2×1 system, the first valve 14 switches position with each pressure cycle of the supply line 24, and the second valve 16 switches position with every two pressure cycles. In the 4×1 system, however, the third valve 94 only switches position with every four pressure cycles, and the fourth valve 96 only switches position with every eight pressure cycles on the primary supply line 24.

Figures 10, 11:
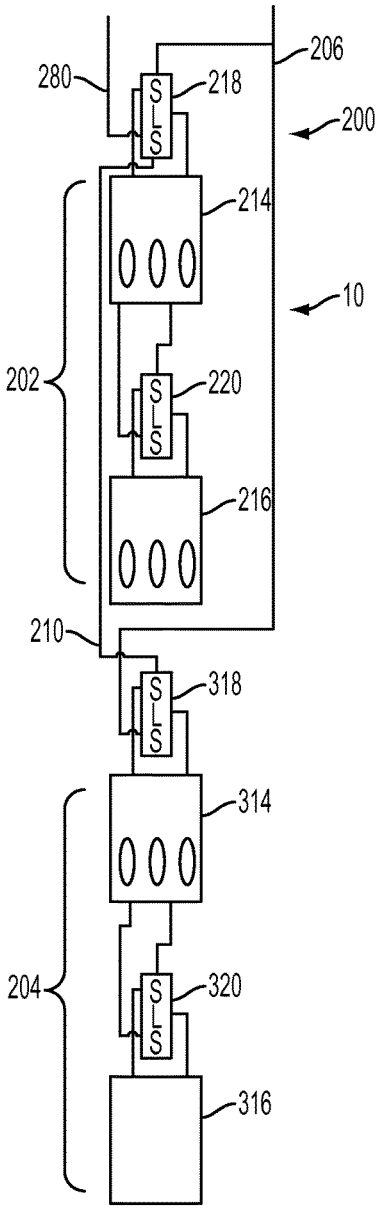
FIG. 10 depicts a schematic of an exemplary embodiment of a 4×2 control system for pressure-controlled valves in a downhole completion system; and, FIG. 11 depicts a table of valve positions using the control system of FIG. 10.

With reference to FIGS. 10 and 11, the control system 10 is expanded to include a 4×2 crossflow system 200. The crossflow system 200 of FIGS. 10 and 11 allows hydraulic returns to be vented to the surface rather than vented downhole. The 4×2 crossflow system 200 is depicted as including four valves, divided into banks (sets) of two, the first set 202 including the first and second valves 14, 16 (referred to as 214, 216), and the second set 204 including the third and fourth valves 314, 316. Alternatively, each bank could include more than two valves (such as shown in the embodiment depicted in FIG. 8), and either bank could include a single valve, however if both banks only included a single valve, then each valve would include its own control line and a significant reduction in control lines would not be realized. In the embodiment shown in FIG. 10, pressuring up on a first control line 206 cycles the first set 202 of the valves 214, 216 through their combinations of open/close positions (as in the embodiment shown in and described with respect to FIG. 1) via the first and second switches 18, 20 (referred to as 218, 220). Because the first control line 206 is also connected to an exhaust port of a third switch 318 for the third valve 314 in the second set 204 of valves 314, 316, and because the third switch 318 of the third valve 314 is in the home position, repeated pressure cycles on the first control line 206 do not serve to change positions of the third and fourth valves 314, 316. However, pressuring up on a second control line 208 (which otherwise serves as the vent line when pressure is supplied to first control line 206) and fluidically connected third control line 210 cycles the second set 204 of valves 314, 316 through their combinations of open/close positions via the switches 318, 320 while venting through the first control line 206, while the first set 202 of switches 214, 216 remain in their home position.

Thus, a control system 10 has been described that employs less control lines (more zones with less lines), is easy to control, and is efficient. The control system 10 eliminates any J-track failure modes that may be experienced in parallel valve systems, and the control system 10 cannot get into a condition that would require intervention to re-synchronize. The control system 10 is also easily reconfigurable to different open/close scenarios, e.g. 3×2, 4×3, 4×1, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A control system comprising a set of pressure-controlled devices including at least a first device and a second device, each device movable between at least first and second positions;

a set of single line switches including at least a first switch and a second switch, each switch configured to move the pressure-controlled devices, respectively, between the first and second positions, the first device alternating between the first position and the second position with every position changing pressure pulse to the first switch, and the second device only alternating between the first position and the second position with every two position changing pressure pulses to the first switch;

a primary supply line connected to a supply port of the first switch, the primary supply line configured to supply the position changing pressure pulses to the supply port and through a pathway in the first switch; and a connecting supply line arranged to fluidically connect the position changing pressures pulses passed through the pathway and out of the first switch to a supply port of the second switch.

2. The control system of claim 1, wherein the set of pressure-controlled devices includes a third device, and the set of single line switches includes a third switch, and the third device only alternates between first and second positions with every four position changing pressure pulses to the first switch.

3. The control system of claim 2, wherein the set of hydraulic pressure-controlled devices includes a fourth device, and the set of single line switches includes a fourth switch, and the fourth device only alternates between first and second positions with every eight position changing pressure pulses to the first switch.

4. The control system of claim 1, further comprising:

a second set of pressure-controlled devices including at least a third device movable between at least first and second positions; and, a second set of single line switches, including at least a third switch, configured to move the pressure-controlled devices within the second set of pressure-controlled devices, respectively, between first and second positions;

wherein the third device alternates between first and second positions with every position changing pressure pulse to the third switch.

5. The control system of claim 4, further comprising:

a first control line arranged to fluidically connect the supply port of the first switch to an exhaust port of the third switch; and, a second control line arranged to fluidically connect a supply port of the third switch to an exhaust port of the first switch.

6. The control system of claim 5, wherein the first control line and a vent line connected to the first device exhaust fluids from the first device, second device, and third device to a surface location of a borehole.

7. The control system of claim 4, wherein the second set of pressure-controlled devices includes a fourth device movable between at least first and second positions, the second set of single line switches includes a fourth switch configured to move the fourth device between the first and second positions, and the fourth device only alternates between the first and second positions with every two position changing pressure pulses to the third switch.

8. The control system of claim 1, further comprising:

a connecting vent line extending to the second switch and arranged to fluidically connect the first switch to an exhaust port of the second switch.

9. The control system of claim 8, further comprising:

a first position line of the first switch arranged to fluidically connect a first position port of the first switch to the first device; and, a second position line of the first switch arranged to fluidically connect a second position port of the first switch to the first device;

wherein the connecting supply line is fluidically connected to the first position line of the first switch.

10. The control system of claim 9, further comprising:

a first position line of the second switch arranged to fluidically connect a first position port of the second switch to the second device; and, a second position line of the second switch arranged to fluidically connect a second position port of the second switch to the second device;

wherein position changing pressure pulses delivered to the connecting supply line alternatingly delivers a pressure pulse to the first position line of the second switch and the second position line of the second switch to move the second device between the first position and second position.

11. The control system of claim 1, wherein the second switch includes a supply port, and the first and second switches each include a first position port, a second position port, and a spool, the spool having the pathway, the spool arranged for movement between a home position in which the supply port is not fluidically connected to the first position port and the second position port, a first switching position in which the supply port is fluidically connected to the first position port via the pathway, and a second switching position in which the supply port is fluidically connected to the second position port via the pathway.

12. The control system of claim 11, further comprising a J-track device configured to control the position of the spool, the J-track device biasing the spool in the home position.

13. The control system of claim 11, wherein the pathway is a first pathway, and the spool further includes a second pathway, the second pathway aligned with the first position port in the second switching position to exhaust fluids through the second pathway from the first position port.

14. The control system of claim 1, wherein the first device and the second device are flow control valves movable between at least an open position and a closed position.

15. The control system of claim 14, wherein the valves each include a sliding sleeve and at least one radial aperture, the sliding sleeve movable from the open position in which the at least one radial aperture is in fluidic communication with an interior of the valve to the closed position in which the radial aperture is blocked from the interior of the valve by the sliding sleeve.

16. The control system of claim 14, wherein the first position corresponds to the open position and the second position corresponds to the closed position.

17. The control system of claim 14, wherein the first position corresponds to the closed position and the second position corresponds to the open position.

18. A method of controlling a control system for pressure-controlled devices, the pressure-controlled devices including at least a first device and a second device, each device movable between at least first and second positions, the method comprising:

connecting a first single line switch to the first device and a second single line switch to the second device; and, delivering position changing pressure pulses through a supply line to the control system, including delivering position changing pressure pulses to the first single line switch to alternatingly move the first device between the first and second positions with every position changing pressure pulse, and delivering position changing pressure pulses from the first single line switch to the second single line switch to alternatingly move the second device between the first and second positions with no more than every other position changing pressure pulse delivered to the first single line switch;

wherein the first single line switch is interposed within a fluidic flowpath of the position changing pressure pulses between the second single line switch and the supply line.

19. The method of claim 18, wherein delivering position changing pressure pulses to the first single line switch and to the second single line switch includes:

delivering a first position changing pressure pulse to the first single line switch and the second single line switch to move the first and second devices from the first position to the second position;

delivering a second position changing pressure pulse to the first single line switch to move the first device from the second position to the first position while maintaining the second device in the second position;

delivering a third position changing pressure pulse to the first single line switch and the second single line switch to move the first device from the first position to the second position and to move the second device from the second position to the first position; and, delivering a fourth position changing pressure pulse to the first single line switch to move the first device from the second position to the first position while maintaining the second device in the first position.

20. The method of claim 18, wherein the pressure controlled devices include a third device, and delivering position changing pressure pulses to the control system includes delivering position changing pressure pulses to a third single line switch connected to the third device to alternatingly move the third device between the first and second positions with no more than every fourth position changing pressure pulse delivered to the first single line switch.

21. The method of claim 18, wherein the first device and the second device are in a first set of pressure controlled devices, and the control system includes a second set of pressure controlled devices including at least a third device, the method further comprising:

connecting a third single line switch to the third device;

wherein delivering position changing pressure pulses to the control system includes delivering position changing pressure pulses to the third single line switch to alternatingly move the third device between the first and second positions with every position changing pressure pulse to the third single line switch.

22. The method of claim 21, wherein the second set of pressure controlled devices further includes a fourth device, the method further comprising:

connecting a fourth single line switch to the fourth device;

wherein delivering position changing pressure pulses to the control system includes delivering position changing pressure pulses to the fourth single line switch to alternatingly move the fourth device between first and second positions with no more than every other position changing pressure pulse delivered to the third single line switch.

23. The method of claim 21, wherein delivering position changing pressure pulses to the first single line switch fluidically connects to an exhaust port of the third single line switch, and delivering position changing pressure pulses to the third single line switch exhausts fluid through the first single line switch.

* * * * *